US006236369B1

(12) United States Patent
Krishtul et al.

(10) Patent No.: US 6,236,369 B1
(45) Date of Patent: May 22, 2001

(54) UNITARY ANTENNA

(75) Inventors: Izhak Krishtul, Kiryat-Yam; Yachin Boaz Popper, Hosen; Dov Barkay, Ramat-Ishay, all of (IL)

(73) Assignee: Galtronics Ltd., Tiberias (IL)

( * ) Notice: Subject to any disclaimer, the term of this patent is extended or adjusted under 35 U.S.C. 154(b) by 0 days.

(21) Appl. No.: 09/299,519

(22) Filed: Apr. 26, 1999

(51) Int. Cl.[7] ..... H01Q 1/24
(52) U.S. Cl. ..... 343/702; 343/906
(58) Field of Search ..... 343/702, 715, 343/895, 900, 903, 906; H01Q 1/24, 1/36

(56) References Cited

U.S. PATENT DOCUMENTS 3,182,329 * 5/1965 Biesecker ..... 343/702
3,560,981 * 2/1971 Pestka ..... 343/702
5,546,094 * 8/1996 Egashira ..... 343/702
5,748,150 * 5/1998 Rudisill ..... 343/702
5,757,325 * 5/1998 Saldell ..... 343/702
5,856,806 * 1/1999 Koleda ..... 343/702
6,037,906 * 3/2000 Engblom ..... 343/702

* cited by examiner

*Primary Examiner*—Tho Phan
(74) *Attorney, Agent, or Firm*—Ladas and Parry

(57) ABSTRACT

A retractable antenna for a communication device having an antenna receptacle includes a whip portion, including a conductive rod, and a connector, which includes a base portion of the conductive rod that is formed so as to be received and retained by the receptacle. Preferably, the base portion is bent so as to have a radial outer dimension greater than a radial inner dimension of the receptacle, so that the base portion is compressed radially when it is received by the receptacle.

13 Claims, 1 Drawing Sheet

UNITARY ANTENNA

FIELD OF THE INVENTION

The present invention relates generally to antennas, and specifically to retractable antennas for mobile communication devices.

BACKGROUND OF THE INVENTION

Retractable antennas used in mobile communication devices, such as cellular telephones, typically comprise a whip, which extends out of the case of the telephone, and a connector at the base of the whip. When the antenna is fully extended, the connector engages a receptacle in the case. The receptacle must hold the connector firmly, so as to provide both mechanical support and electrical contact to the whip. To fulfill these requirements, the connector generally comprises a resilient structure such as a spring clip, which is soldered or welded to the base of the whip. The clip is compressed and held by the receptacle when the antenna is pulled out into the extended position. Alternatively or additionally, the receptacle may include a resilient retainer element, such as a spring, to hold the connector in place.

The connector itself and the steps involved in fastening it with sufficient precision to the whip are costly. Moreover, the connector itself and the joint between the connector and the whip increase the overall weight of the antenna and are prone to failure with use over the life of the communication device.

SUMMARY OF THE INVENTION

It is an object of the present invention to provide an improved antenna for mobile communication devices.

It is a further object of some aspects of the present invention to provide a retractable antenna at reduced cost.

It is yet a further object of some aspects of the present invention to provide a retractable antenna with improved reliability.

In preferred embodiments of the present invention, a retractable antenna for a mobile communication device comprises a rod of resilient, conductive material. A base portion of the rod is formed, preferably by introducing one or more bends in the rod, so as to serve as a connector for the antenna. To extend the antenna out of the device, the rod is pulled out through the receptacle until the bent base portion is drawn into the receptacle and compressed thereby. The compression provides both firm mechanical support and electrical contact to the rod, which serves as the whip of the antenna. The entire antenna is thus formed of a single piece of the conductive material, affording advantages of reduced cost and weight and improved reliability relative to antennas known in the art.

Although preferred embodiments of the present invention are described with relation to mobile communication devices, it will be appreciated that the principles of the present invention may similarly be applied to produce antennas for other communication devices and systems, as well.

There is therefore provided, in accordance with a preferred embodiment of the present invention, a retractable antenna for a communication device having an antenna receptacle, including:

a whip portion, including a conductive rod; and a connector, which includes a base portion of the conductive rod that is formed so as to be received and retained by the receptacle.

Preferably, the base portion is bent so as to have a radial outer dimension greater than a diameter of the rod and, most preferably, greater than a radial inner dimension of the receptacle, so that the base portion is compressed radially when it is received by the receptacle. In a preferred embodiment, the base portion is formed so as to include multiple bends.

Preferably, the conductive rod includes a resilient material, most preferably a superelastic material.

Preferably, the base portion provides electrical contact between the whip portion and the receptacle.

Further preferably, the connector includes only the base portion of the conductive rod, substantially without any other conductive element.

There is also provided, in accordance with a preferred embodiment of the present invention, a method for producing an antenna, including:

providing a conductive rod to serve as a whip portion of the antenna; and forming a base portion of the conductive rod so as to serve as a connector, which is received and retained by an antenna receptacle.

Preferably, forming the base portion includes bending the base portion so that it has a radial outer dimension greater than a diameter of the rod, wherein bending the base portion most preferably includes forming multiple bends therein. Further preferably, the rod includes elastic material, and bending the base portion includes exerting a sufficient pressure on the rod so that it becomes plastic.

In an alternative embodiment, providing the rod and forming the base portion include casting the rod and base portion in a die.

Preferably, forming the base portion includes forming a resilient structure, which is compressed radially when it is received by the receptacle.

Further preferably, forming the base portion includes forming the connector using only the base portion of the conductive rod, substantially without any other conductive element.

The present invention will be more fully understood from the following detailed description of the preferred embodiments thereof, taken together with the drawings in which:

DETAILED DESCRIPTION OF A PREFERRED EMBODIMENT

Figure 1:
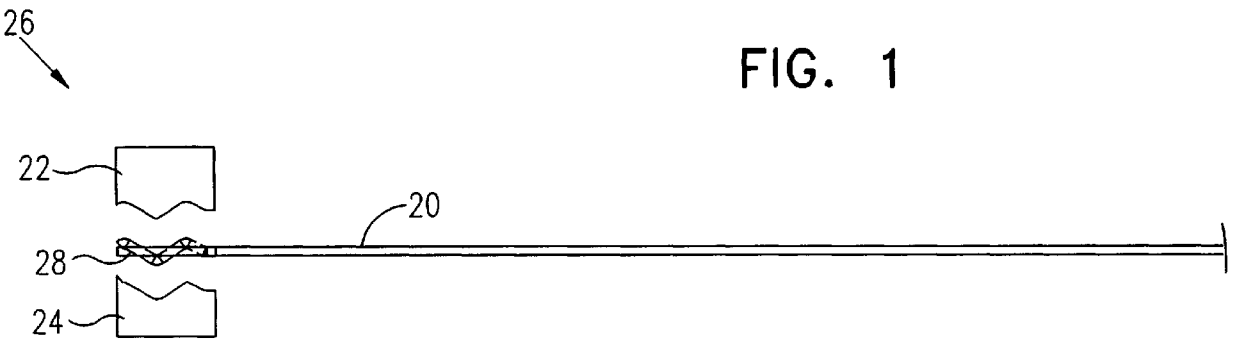
FIG. 1 is a schematic view of a conductive rod and a jig that receives the rod, illustrating a method for forming an antenna, in accordance with a preferred embodiment of the present invention.

FIG. 1 is a schematic side view of a jig 26 for forming a resilient, conductive rod 20 into an antenna, in accordance with a preferred embodiment of the present invention. Rod 20 preferably comprises an resilient but formable material, most preferably a wire made of a superelastic alloy, such as nickel titanium (NiTi), as is known in the art. Preferably, the wire has a diameter of about 0.9 mm, and its length is chosen to give optimal antenna response in a selected frequency band, as is known in the art. Jig 26 comprises jaws 22 and 24, which are closed on a base portion 28 of the rod. When the jaws are closed, the pressure on the rod at bends 29 is sufficient so that the rod material becomes plastic at these points, and the base portion is permanently bent into a shape in the form of the jig.

Figure 2A:
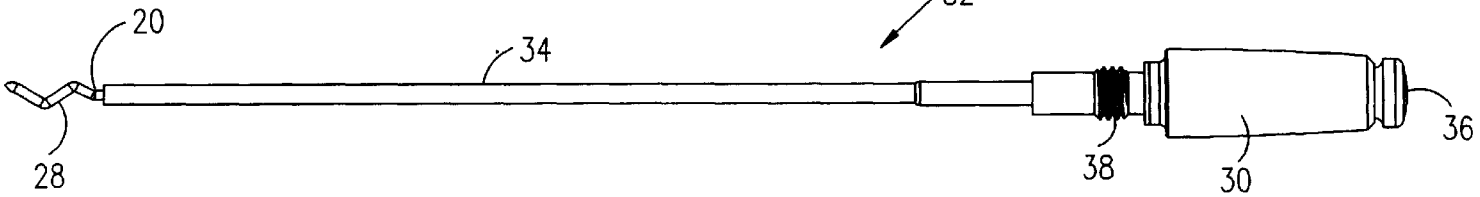
FIG. 2A is a schematic side view of a retractable antenna in a retracted position, in accordance with a preferred embodiment of the present invention.

FIG. 2A is a schematic side view of an antenna 32, which is made from rod 20 following the forming process shown in FIG. 1, in accordance with a preferred embodiment of the present invention. Rod 20 is preferably overcoated with an insulating layer 34, most preferably made of a thermoplastic polyester elastomer. An end cap 36 is fixed to an upper end of the rod, opposite base portion 28. Base portion 28, which has been bent so as to serve as the antenna connector, is not overcoated.

FIG. 2A shows antenna 32 retracted inside a lower antenna element 30, which serves as a receptacle for the antenna. In the preferred embodiment shown here, element 30 contains a coil (not shown), which functions as a helical antenna when antenna 32 is retracted. An antenna connector 38 on element 30 provides both electrical contact and mechanical fastening of the element to the case of a communication device, such as a cellular telephone.

Figure 2B:
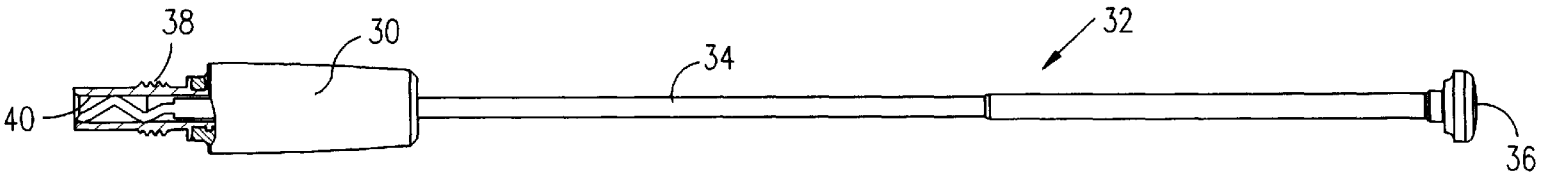
FIG. 2B is a schematic, partly sectional side view of the antenna of FIG. 2A is an extended position.

FIG. 2B is a schematic, partly sectional side view of antenna 32 in an extended position. The antenna has been pulled out through receptacle 30 so that bent base portion 28 is drawn into a bore 40 of the receptacle. Base portion 28 is formed so as to have an radial dimension, i.e., a dimension measured perpendicular to the longitudinal axis of rod 20, that is slightly greater than an inner diameter of bore 40. When the antenna is fully extended, however, the base portion is drawn into and compressed radially by the bore. The resultant outward pressure of portion 28 against bore 40 holds the antenna firmly in the extended position and also provides electrical contact between antenna 32 and connector 38. Because rod 20 comprises highly resilient material, and because base portion 28 is an integral part of the rod, antenna 32 may be extended and retracted an almost unlimited number of times without breakage or failure of the base portion.

Although in the preferred embodiment shown in the figures, base portion 28 has a particular bent configuration, it will be understood that the base portion may similarly be formed into a wide variety of other two- and three-dimensional shapes of appropriate radial dimensions and mechanical properties to serve as the antenna connector. Since the connector and the whip. are made from a single, integral piece of material, no precision forming or assembly is required. Similarly, various resilient materials may be used, in place of NiTi, along with various methods, such as die casting, of forming the base portion, as are known in the art and appropriate to the material chosen.

It will thus be appreciated that the preferred embodiment described above is cited by way of example, and the full scope of the invention is limited only by the claims.

What is claimed is:

1. A retractable antenna for a communication device having an antenna receptacle, comprising:

a whip portion, comprising a conductive rod; and a generally elongated connector portion integrally formed with said whip portion as one piece, which comprises a base portion of the conductive rod that is formed so as to be, received and retained by the receptacle, wherein the base portion is bent so as to have a radial outer dimension greater than a diameter of the rod.

2. An antenna according to claim 1, wherein the radial outer dimension of the base portion is greater than a radial inner dimension of the receptacle, so that the base portion is compressed radially when said base portion is received by the receptacle.

3. An antenna according to claim 1, wherein the base portion is formed so as to include multiple bends.

4. An antenna according to claim 1, wherein the conductive rod comprises a resilient material.

5. An antenna according to claim 4, wherein the conductive rod comprises a superelastic material.

6. An antenna according to claim 1, wherein the base portion provides electrical contact between the whip portion and the receptacle.

7. An antenna according to claim 1, wherein the connector comprises only the base portion of the conductive rod, substantially without any other conductive element.

8. A method for producing an antenna comprising:

providing a conductive rod to serve as a whip portion of the antenna; and integrally forming a base portion of the conductive rod so as to serve as a generally elongated connector portion integrally formed with said whip portion as one piece, which is adapted to be received and retained by an antenna receptacle; and bending the base portion so that said base portion has a radial outer dimension greater than a diameter of the rod.

9. A method according to claim 8, wherein bending the base portion comprises forming multiple bends therein.

10. A method according to claim 8, wherein the rod comprises elastic material, and wherein bending the base portion comprises exerting a sufficient pressure on the rod so that said base portion becomes plastic.

11. A method according to claim 8, wherein providing the rod and forming the base portion comprise casting the rod and base portion in a die.

12. A method according to claim 8, wherein forming the base portion comprises forming a resilient structure, which is compressed radially when said base portion is received by the receptacle.

13. A method according to claim 8, wherein forming the base portion comprises forming the connector using only the base portion of the conductive rod, substantially without any other conductive element.

* * * * *